US008028798B2

(12) United States Patent
Koyanagi et al.

(10) Patent No.: US 8,028,798 B2
(45) Date of Patent: Oct. 4, 2011

(54) EXHAUST PIPE STRUCTURE FOR SADDLE-RIDE TYPE VEHICLE

(75) Inventors: Masashi Koyanagi, Wako (JP); Yoichi Shihozawa, Wako (JP); Taichi Mori, Wako (JP); Hayato Yamazaki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/635,277

(22) Filed: Dec. 10, 2009

(65) Prior Publication Data

US 2010/0192880 A1 Aug. 5, 2010

(30) Foreign Application Priority Data

Jan. 30, 2009 (JP) ..... 2009-020677

(51) Int. Cl.
*F01N 1/02* (2006.01)

(52) U.S. Cl. ..... 181/251; 181/212; 181/227; 181/238; 181/239; 181/240; 60/299; 60/302; 60/306

(58) Field of Classification Search ..... 181/212, 181/227, 251, 238, 239, 240, 256; 60/299, 60/302, 306

See application file for complete search history.

(56) References Cited

U.S. PATENT DOCUMENTS

| | | | | | |
|---|---|---|---|---|---|
| 3,072,214 | A * | 1/1963 | Deremer | 181/250 |
| 5,519,994 | A * | 5/1996 | Hill | 60/313 |
| 5,608,194 | A * | 3/1997 | Okazaki et al. | 181/228 |
| 5,708,238 | A * | 1/1998 | Asao et al. | 181/272 |
| 5,979,583 | A * | 11/1999 | Amino et al. | 180/219 |
| 6,334,501 | B1 * | 1/2002 | Kawamoto | 180/309 |
| 6,485,694 | B1 * | 11/2002 | Reck et al. | 422/180 |
| 7,624,842 | B2 * | 12/2009 | Mizutani | 181/249 |

FOREIGN PATENT DOCUMENTS

| | | | |
|---|---|---|---|
| JP | 60093111 | A * | 5/1985 |
| JP | 63134809 | A * | 6/1988 |
| JP | 3196953 | B2 | 8/2001 |

* cited by examiner

*Primary Examiner* — Forrest M Phillips
(74) *Attorney, Agent, or Firm* — Westerman, Hattori, Daniels & Adrian, LLP

(57) ABSTRACT

An exhaust-pipe structure for a saddle-ride type vehicle includes expansion paths each having a capacity appropriate for the output capacity of a corresponding cylinder. A front exhaust pipe and a rear exhaust pipe extend from a front cylinder and a rear cylinder constituting a V-type engine, respectively. A silencer is connected to rear end portions of the front and rear exhaust pipes. As expansion chambers, the silencer is provided with a lower first chamber led from the front cylinder and an upper first chamber led from the rear cylinder. A protruding space protruding from the lower first chamber is formed so that the capacity of the lower first chamber led from the front cylinder is larger than the capacity of the upper first chamber led from the rear cylinder.

6 Claims, 8 Drawing Sheets

EXHAUST PIPE STRUCTURE FOR SADDLE-RIDE TYPE VEHICLE

TECHNICAL FIELD

The present invention relates to improvement in an exhaust pipe structure for a saddle-ride type vehicle.

BACKGROUND OF THE INVENTION

The following exhaust pipe structure for motorcycle is known. In the exhaust pipe structure, exhaust pipes extend from respective cylinders of a multicylinder engine, and a single silencer is placed at downstream ends of these exhaust pipes. The silencer is divided into expansion paths which are independent of one another and are equal in number to the number of the cylinders in the multicylinder engine. (For example, see Japanese Patent No. 3196953, FIGS. 6 and 7).

In FIG. 6 of Japanese Patent No. 3196953, a muffler (hereinafter, the muffler is referred to as the "silencer," of a motorcycle has three independent expansion paths led from the respective cylinders. By partitions provided to radially extend in a tubular member, each of these three expansion paths is divided into three expansion chambers: a first expansion chamber, a second expansion chamber, and a third expansion chamber. The first expansion chamber and the second expansion chamber communicate with each other by a pipe, and the second expansion chamber and the third expansion chamber communicate with each other by a pipe.

In FIG. 7 of Japanese Patent No. 3196953, the silencer is divided into the three independent expansion paths by partition plates extending axially in the tubular member. The exhaust pipes extending from the cylinders are led to these three expansion paths, respectively. The three expansion paths provided in the tubular member have almost the same capacity. Note that the capacity is a volume that a container can hold.

SUMMARY OF THE INVENTION

Cylinders constituting a multicylinder engine are different from each other in their positions and orientations, and consequently, in their intake efficiencies and the like. Difference in the intake efficiencies may cause an output difference among the cylinders. It is preferable that the silencer have expansion paths each having a capacity, in a limited space, appropriate for the output capacity of the corresponding cylinder because such silencer allows the engine to achieve higher performance and thereby to improve its output.

An exhaust-pipe structure for a saddle-ride type vehicle includes expansion paths each having an appropriate capacity according to the output capacity of a corresponding cylinder.

A first aspect provides an exhaust-pipe structure for a saddle-ride type vehicle, in which exhaust pipes are led from respective cylinders of a multicylinder engine, and in which a single silencer is connected to downstream ends of the exhaust pipes, the silencer having formed therein independent expansion paths that are equal in number to the number of the cylinders of the multicylinder engine. In the exhaust-pipe structure, the expansion paths led from the respective cylinders have different capacities from one another.

A second aspect provides the exhaust-pipe structure for a saddle-ride type vehicle characterized as follows. The expansion path for one of the cylinders is formed to protrude to a side of the expansion path for a different one of the cylinders, so that a capacity of a first chamber provided in the expansion path for the one cylinder is different from a capacity of a first chamber provided in the expansion path for the different cylinder.

A third aspect provides the exhaust-pipe structure for a saddle-ride type vehicle characterized as follows. The expansion path for the one of the cylinders and the expansion path for at least one different cylinder of the cylinders communicate with each other via a through hole, through which an exhaust gas passes.

A fourth aspect provides the exhaust-pipe structure for a saddle-ride type vehicle characterized as follows. The part protruding to the side of the expansion path for the different cylinder is a protruding portion of the one cylinder, and the protruding portion is placed between the multicylinder engine and the first chamber provided in the expansion path for the different cylinder.

A fifth aspect provides the exhaust-pipe structure for a saddle-ride type vehicle characterized as follows. The multicylinder engine is a V-type engine having a crankshaft extending in a vehicle-width direction and being formed of a front cylinder and a rear cylinder. The capacity of the first chamber of the expansion path led from the front cylinder is larger than that of the first chamber of the expansion path led from the rear cylinder.

A sixth aspect provides an exhaust-pipe structure for a saddle-ride type vehicle in which exhaust pipes are led from respective cylinders of a multicylinder engine, and a silencer is connected to downstream ends of the exhaust pipes, the silencer having formed therein independent expansion paths that are equal in number to the number of the cylinders of the multicylinder engine. In the exhaust-pipe structure, the expansion path for one of the cylinders is formed to protrude to a side of the expansion path for at least one different cylinder of the cylinders, so that a capacity of a first chamber provided in the expansion path for the one cylinder is different from a capacity of a first chamber provided in the expansion path for the different cylinder.

According to the first aspect, in a multicylinder engine, the expansion paths, in the single silencer, led from the respective cylinders have different capacities from one another.

Cylinders constituting a multicylinder engine are different from each other in their positions and orientations, and consequently, in their intake efficiencies and the like. Difference in the intake efficiencies causes an output difference among the cylinders.

Even in the case where there is an output difference among the cylinders, the expansion paths led from the respective cylinders have the same capacity in some cases. In such a case, the expansion path led from a cylinder having a large output has a high pressure against the exhaust-gas discharge (also called an exhaust back pressure below), and the expansion path led from a cylinder having a small output has a low exhaust back pressure, possibly not allowing the cylinders to fully exert their capabilities.

In this respect, the expansion paths led from the respective cylinders have different capacities in the present invention. For example, an expansion path having a large capacity is connected to a cylinder having a large exhaust back pressure, and an expansion path having a small capacity is connected to a cylinder having a small exhaust back pressure. Thereby, proper capacity allocation can be carried out in a single silencer, allowing an efficient improvement in the performance of the engine.

According to the second aspect, the expansion path for one of the cylinders is formed protruding to the side of the expansion path for a different one of the cylinders, so that the capacity of the first chamber provided in the expansion path for the one cylinder is different from the capacity of the first chamber provided in the expansion path for the different cylinder. Accordingly, an appropriate capacity for its expansion path can be allocated to each of the cylinders by efficiently using the overall capacity of the single silencer. Consequently, the performance of the engine can be efficiently improved without increasing the size of the silencer.

According to the third aspect, the expansion path for one of the cylinders and the expansion path for at least one different cylinder of the cylinders communicate with each other via the through hole, through which an exhaust gas passes.

The provision of the through hole in a separator dividing the chambers from one another allows the expansion paths corresponding to the respective cylinders to communicate with each other. Accordingly, the performance of the engine can be efficiently improved while maintaining the rigidity of the separator without increasing the number of components.

According to the fourth aspect, the part protruding to the side of the expansion path for the different cylinder is a protruding portion of the one cylinder, and the protruding portion is placed between the multicylinder engine and the first chamber provided in the expansion path for the different cylinder. When the expansion path led from the one cylinder is provided close to the multicylinder engine, a pressure against the exhaust-gas discharge (exhaust back pressure) in the expansion paths can be effectively reduced.

According to the fifth aspect, in a V-type engine in which the front cylinder and the rear cylinder have a narrow angle therebetween with the crankshaft being the center, the front cylinder has a better intake efficiency than the rear cylinder. According to such an output difference, the capacity of the first chamber in the expansion path led from the front cylinder is made larger than the capacity of the first chamber in the expansion path led from the rear cylinder, to thereby reduce the exhaust back pressure in the expansion paths. By reducing the exhaust back pressure, the engine output can be improved. Further, an exhaust noise and output characteristics can be varied by increasing the output difference between the front and rear cylinders.

According to the sixth aspect, the expansion path for one of the cylinders is formed to protrude to the side of the expansion path for at least one different cylinder of the cylinders, so that the capacity of the first chamber provided in the expansion path for the one cylinder is different from the capacity of the first chamber provided in the expansion path for the different cylinder. Accordingly, each of the cylinders can be allocated an appropriate capacity for its expansion path by efficiently using the overall capacity of the silencer. Consequently, the performance of the engine can be efficiently improved without increasing the size of the silencer.

BRIEF DESCRIPTION OF THE DRAWINGS

The advantages of the invention will become apparent in the following description taken in conjunction with the drawings, wherein.

DETAILED DESCRIPTION OF THE INVENTION

Figure 1:
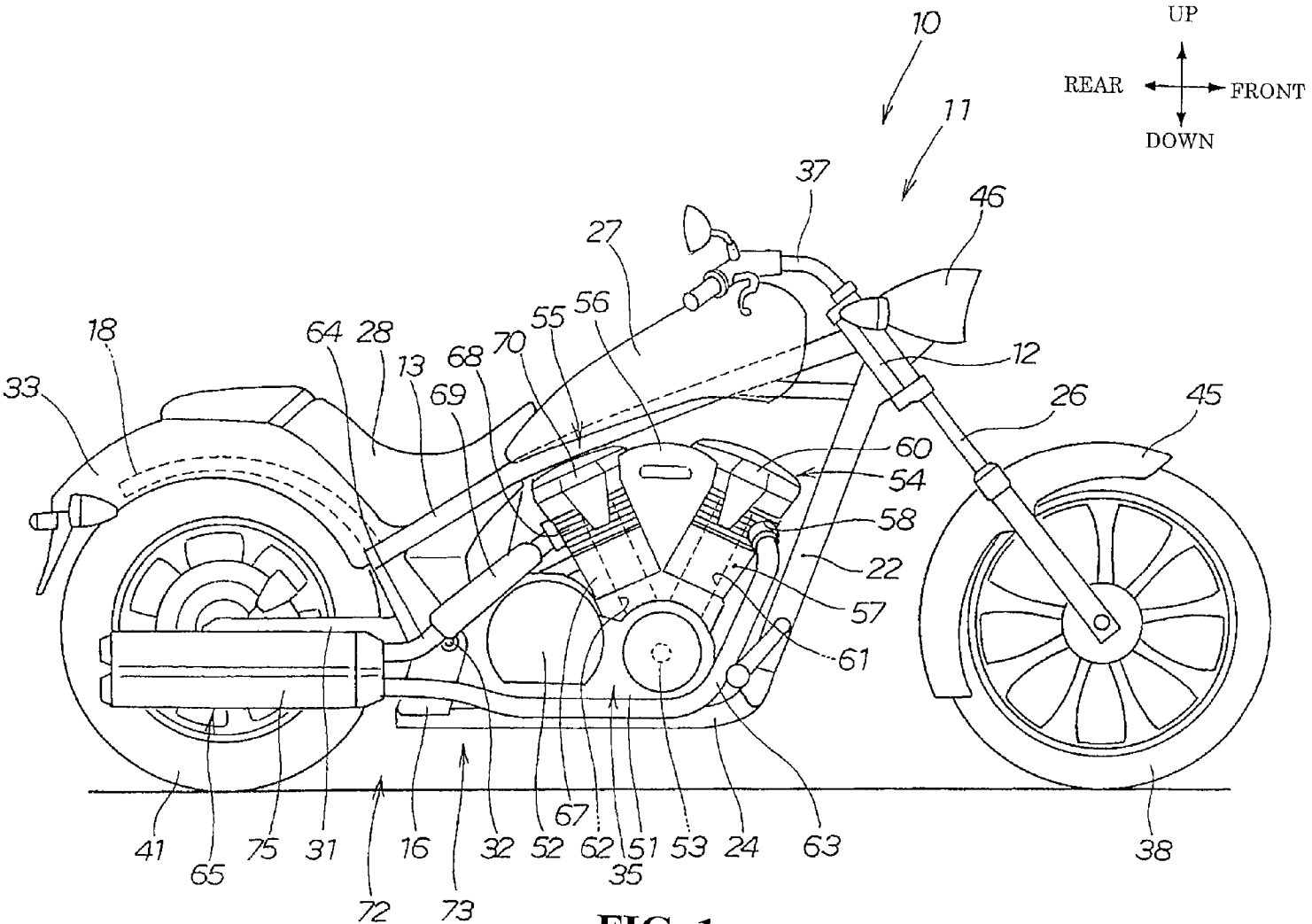
FIG. 1 is a right-side view of a saddle-ride type vehicle according to the present invention.

An embodiment of the present invention is described in detail below. The "front," "rear," "left," "right," "up," and "down" in the drawings are directions as viewed from the rider on the saddle-ride type vehicle. Note that the drawings are to be viewed according to the orientation of the reference numerals.

In FIG. 1, a motorcycle 10 being a saddle-ride type vehicle is a vehicle having the following structure. A body frame 11 of the motorcycle 10 includes a head pipe 12 provided at a front end, a main frame 13, paired left and right pivot frames 15, 16 (only reference numeral 16 on the near side is shown), paired left and right rear frames 17 and 18 (only reference numeral 18 on the near side is shown), paired left and right down frames 21, 22 (only reference numeral 22 on the near side is shown), and paired left and right lower frames 23, 24 (only reference numeral 24 on the near side is shown). The main frame 13 extends from the head pipe 12 rearward and obliquely downward. The pivot frames 15, 16 and the rear frames 17, 18 are attached to a rear end portion of the main frame 13. The down frames 21, 22 extend from the head pipe 12 rearward and obliquely downward below the main frame 13. Each of the lower frames 23, 24 extends integrally from a lower end of a corresponding one of the down frames 21, 22 rearward, and is joined to a lower end of a corresponding one of the pivot frames 15, 16. A front fork 26 is steerably attached to the head pipe 12. A fuel tank 27 and a rider's seat 28 are attached to an upper portion of the main frame 13. A swing arm 31 is swingably attached to the pivot frames 15, 16 through a pivot shaft 32. A rear fender 33 is attached to the rear frames 17, 18. A V-type engine 35 (also called the "engine 35" below) is attached to the down frames 21, 22 and the lower frames 23, 24. A handlebar 37 and a front wheel 38 are attached to the front fork 26 at its upper end and at its lower end, respectively. A rear wheel 41 is attached to a rear end of the swing arm 31.

Further, the front fork 26 is provided with a head lamp 46 at its upper portion, and with a front fender 45 at its middle portion to cover the front wheel 38 from above.

The engine 35 is a power unit integrally including a transmission 52 behind a crankcase 51. A crankshaft 53 extends in the crankcase 51 in a vehicle-width direction. The engine 35 has a front cylinder part 54 (also called the "front bank 54" below) extending from the crankshaft 53 upward and obliquely frontward and a rear cylinder part 55 (also called the "rear bank 55" below) extending from the crankshaft 53 upward and obliquely rearward.

A fuel supply device 56 is placed between the front cylinder part 54 and the rear cylinder part 55 to supply a mixture of gas to the front cylinder part 54 and to the rear cylinder part 55.

The front cylinder part 54 includes a front cylinder block 57, a front cylinder head 58, a front head cover (not shown), and a front overhead cover 60. The front cylinder block 57 is attached to an upper front portion of the crankcase 51, and the front cylinder head 58 is attached to an upper portion of the front cylinder block 57. The front head cover covers the front cylinder head 58 from above, and the front overhead cover 60 covers around the front head cover. With the structure described above, a front cylinder 61 as a fuel chamber is formed in the front cylinder part 54.

A front exhaust pipe 63 extends from the front cylinder 61 downward and then rearward. A rear end portion of the front exhaust pipe 63 is connected to a silencer 65 that constitutes expansion chambers.

The rear cylinder part 55 includes a rear cylinder block 67, a rear cylinder head 68, a rear head cover (not shown), and a rear overhead cover 70. The rear cylinder block 67 is attached to an upper rear portion of the crankcase 51, and the rear cylinder head 68 is attached to an upper portion of the rear cylinder block 67. The rear head cover covers the rear cylinder head 68 from above, and the rear overhead cover 70 covers around the rear head cover. With the structure described above, a rear cylinder 62 as a fuel chamber is formed in the rear cylinder part 55.

A rear exhaust pipe 64 extends from the rear cylinder 62 rearward. A rear end portion of the rear exhaust pipe 64 is connected to the silencer 65. Reference numeral 69 denotes a protector.

As described, in the present embodiment, the multicylinder engine is the V-type two-cylinder engine 35 including the front cylinder 61 and the rear cylinder 62, and is of a type in which the crankshaft 53 extends in the vehicle-width direction.

The V-type two-cylinder engine 35 has an exhauster 72 constituting an exhaust system. The exhauster 72 includes an exhaust pipe 73, the silencer 65, and a silencer cover 75. The exhaust pipe 73 extends from the engine 35, and the silencer 65 is connected to a downstream end of the exhaust pipe 73. The silencer cover 75 covers the silencer 65.

Note that the exhaust pipe 73 includes the front exhaust pipe 63 extending from the front cylinder part 54 of the engine 35, and the rear exhaust pipe 64 extending from the rear cylinder part 55 of the engine 35.

In the present embodiment, the multicylinder engine is a narrow-angle, V-type two-cylinder engine. It should be noted, however, that the multicylinder engine may have any number of cylinders, such as three cylinders, four cylinders, five cylinders, and six cylinders. Moreover, the type of the multicylinder engine is not limited to a V type, and the multicylinder engine may be a horizontally-opposed engine, an in-line engine, or an engine of other types.

Figure 2:
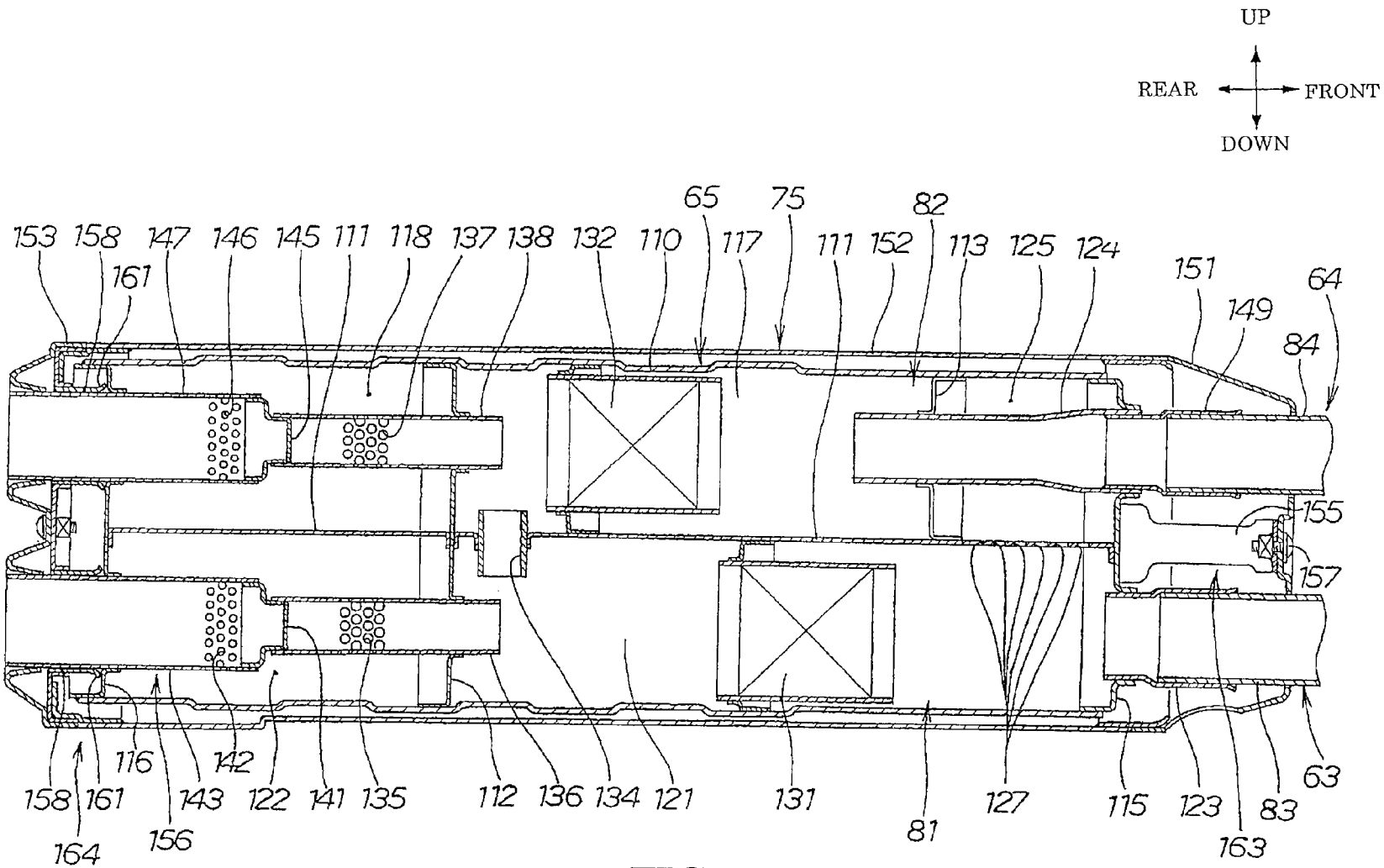
FIG. 2 is a cross-sectional view taken along the side of a silencer included in the saddle-ride type vehicle according to the present invention.

In FIG. 2, the silencer 65 is divided vertically to have a lower-side expansion path 81 and an upper-side expansion path 82. A rear end portion 83 of the front exhaust pipe 63 is connected to the lower-side expansion path 81, while a rear end portion 84 of the rear exhaust pipe 64 is connected to the upper-side expansion path 82.

A detailed structure of the silencer 65 is described below. The main structure of the silencer 65 is as follows. The silencer 65 includes an outer casing 110, a first separator 111, a front wall part 115, a rear wall part 116, a second separator 112, a first input pipe 123, a third separator 113, a second input pipe 124, through holes 127, a first catalyst unit 131, a second catalyst unit 132, a communication hole 134, a lower joining pipe 136, an upper joining pipe 138, a lower tail pipe 143, and an upper tail pipe 147. Specifically, the first separator 111 divides the outer casing 110 into the lower-side expansion path 81 and the upper-side expansion path 82. The outer casing 110 is sealed by the front wall part 115 and the rear wall part 116 at a front end portion and a rear end portion, respectively. Between the front wall part 115 and the rear wall part 116, the second separator 112 divides the upper expansion path 82 into an upper first chamber 117 and an upper second chamber 118, and divides the lower expansion path 81 into a lower first chamber 121 and a lower second chamber 122. The first input pipe 123 penetrates the front wall part 115 and extends in an axial direction of the outer casing 110 to the lower first chamber 121, while being connected to the rear end portion 83 of the front exhaust pipe 63 to supply an exhaust gas exhausted from the front bank 54, to the lower first chamber 121. The third separator 113 is placed between the front wall part 115 and the second separator 112, and divides the upper first chamber 117 frontwardly and rearwardly, thereby forming a space 125 in front of the third separator 113. The second input pipe 124 penetrates the third separator 113 and the front wall part 115, and extends in the axial direction of the outer casing 110 to the upper first chamber 117, which has a reduced capacity relative to the lower first chamber 121. The second input pipe 124 is connected to the rear end portion 84 of the rear exhaust pipe 64 to supply an exhaust gas exhausted from the rear bank 55, to the upper first chamber 117 which has a capacity reduced by the third separator 113. The through holes 127 are opened in the first separator 111 at a part facing the space 125 to allow communication of an exhaust gas between the space 125 and the lower first chamber 121. The first catalyst unit 131 is provided in the lower first chamber 121, and the second catalyst unit 132 is provided in the upper first chamber 117. The communication hole 134 is opened in the first separator 111 at a position rearward of the first catalyst unit 131 and the second catalyst unit 132 to allow communication of an exhaust gas between the lower first chamber 121 and the upper first chamber 117. The lower joining pipe 136 penetrates the second separator 112, has multiple holes 135 on a side facing the lower second chamber 122, and leads an exhaust gas from the lower first chamber 121 to the lower second chamber 122. The upper joining pipe 138 penetrates the second separator 112, has multiple holes 137 on a side facing the upper second chamber 118, and leads an exhaust gas from the upper first chamber 117 to the upper second chamber 118. The lower tail pipe 143 has a lid part 141 at its front end portion and rear multiple holes 142 in its outer circumference. The lid part 141 is inserted into the lower tail pipe 143 so as to seal the lower joining pipe 136. The lower tail pipe 143 leads an exhaust gas from the lower second chamber 122 to the outside. The upper tail pipe 147 has a lid part 145 at its front end portion and rear multiple holes 146 in its outer circumference. The lid part 145 is inserted into the upper tail pipe 147 so as to seal the upper joining pipe 138. The lower tail pipe 143 leads an exhaust gas from the upper second chamber 118 to the outside.

The space 125 (also called the "protruding space 125" below) is used as part of the lower first chamber 121 of the expansion path 81 led from the front cylinder 61. Thereby, the capacity of the lower first chamber 121 of the expansion path 81 being led from the front cylinder 61 and constituting the silencer 65 is made larger than the capacity of the upper first chamber 117 being the expansion path 82 led from the rear cylinder 62.

The lower expansion path 81, which is an expansion path for one of the cylinders, communicates with the upper expansion path 82, which is an expansion path for at least one different cylinder of the cylinders, through the through holes 127 through which an exhaust gas passes.

The provision of the through holes 127 in the first separator 111 dividing the cylinders from one another allows the expansion paths 81 and 82 of the respective cylinders to communicate with each other. Accordingly, the performance of the engine (denoted by reference numeral 35 in FIG. 1) can be efficiently improved while maintaining the rigidity of the first separator 111 without increasing the number of components.

Moreover, the lower first chamber 121 serving as the expansion path for one of the cylinders communicates with the upper first chamber 117 serving as the expansion path for at least one different cylinder of the cylinders through the communication hole 134 through which an exhaust gas passes. By using the communication hole 134, an output of the engine 35 can be improved without deteriorating the rigidity of the silencer 65.

In the drawing, reference numeral 149 denotes an adapter pipe connecting between the second input pipe 124 and the rear exhaust pipe 64.

In the present embodiment, the first separator 111 divides the outer casing 110 vertically. It should be noted, however, that the outer casing 110 may be divided left and right, or, according to the number of the cylinders, may be divided into three, four, five, or six sections in directions including an oblique upward direction and an oblique downward direction.

The silencer cover 75 is described below. The silencer cover 75 is a member placed outside the silencer 65 to cover the silencer 65. The silencer cover 75 is formed by integrally connecting a front cap member 151, a cover body 152, and a rear cap member 153 in this order from front to rear.

A support part 155 serving as a stay extends frontward from the front wall part 115 constituting a front end portion of the silencer 65. The front cap member 151 is attached to the support part 155 with a fastening screw 157.

A tail pipe 156 extends at a rear end portion of the silencer 65. The tail pipe 156 includes the lower tail pipe 143 and the upper tail pipe 147 that exhaust an exhaust gas to the outside. A stainless-steel mesh spacer 158 is attached around the tail pipe 156 to serve as a buffer. A sliding tubular part 161 provided on the rear wall part 116 side is inserted slidably into the mesh spacer 158. Accordingly, the silencer cover 75 is fixed at one point in the front end portion, as well as being supported slidably at the rear end portion by the tail pipe 156 so that the silencer cover 75 can adapt to a heat expansion of the silencer 65. In other words, the silencer cover 75 is slidably supported by the tail pipe 156 constituting a rear end portion 164 of the silencer 65.

By being placed between the tail pipe 156 and the sliding tubular part 161, the stainless-steel mesh spacer 158 serves as a buffer and fills the space formed between the silencer cover 75 and the silencer 65. Thereby, vibrations and sound possibly occurring between the rear end portion of the silencer cover 75 and the silencer 65 can be reduced.

The support part 155 supporting the silencer cover 75 is placed at a front end portion 163 of the silencer 65. The silencer cover 75 is placed so that portions other than the support part 155 may have a clearance from the silencer 65. This makes it hard for heat of the silencer 65 to be transmitted to the silencer cover 75, and also makes it hard for vibrations of the silencer 65 to be transmitted to the silencer cover 75.

The silencer cover 75 is made of metal and has its surface plated. The silencer cover 75 is fixed through the fixing support part 155 provided to the silencer 65. The tail pipe 156 at the rear end portion is provided in such a manner as to be slidable to the silencer cover 75. Accordingly, even if the silencer 65 expands by heat of an exhaust gas or the like to extend rearward with the fixing support part 155 fixed as a base, the silencer cover 75 can adapt to the heat expansion.

The silencer cover 75 is fixed to the silencer 65 through the support part 155 provided at the front end portion 163 of the silencer 65, and the silencer 65 is supported at the rear end portion 164 in such a manner as to be slidable relative to the silencer cover 75. Accordingly, compared to a case where the silencer 65 is slidably supported at a middle portion for example, the silencer cover 75 can be supported in a balanced manner, and a smooth heat expansion of the silencer 65 is allowed between the silencer 65 and the silencer cover 75. A balanced support of the silencer 65 allows a smooth heat expansion of the silencer 65 between the silencer 65 and the silencer cover 75.

Since the rear end portion 164 of the silencer 65 is the tail pipe 156, there is no need for an additional member such as a stay. Consequently, this simplifies the structure for allowing the silencer 65 to be slidable, preventing an increase in the number of components.

Operations of the silencer 65 having the above structure are described next.

Figure 3:
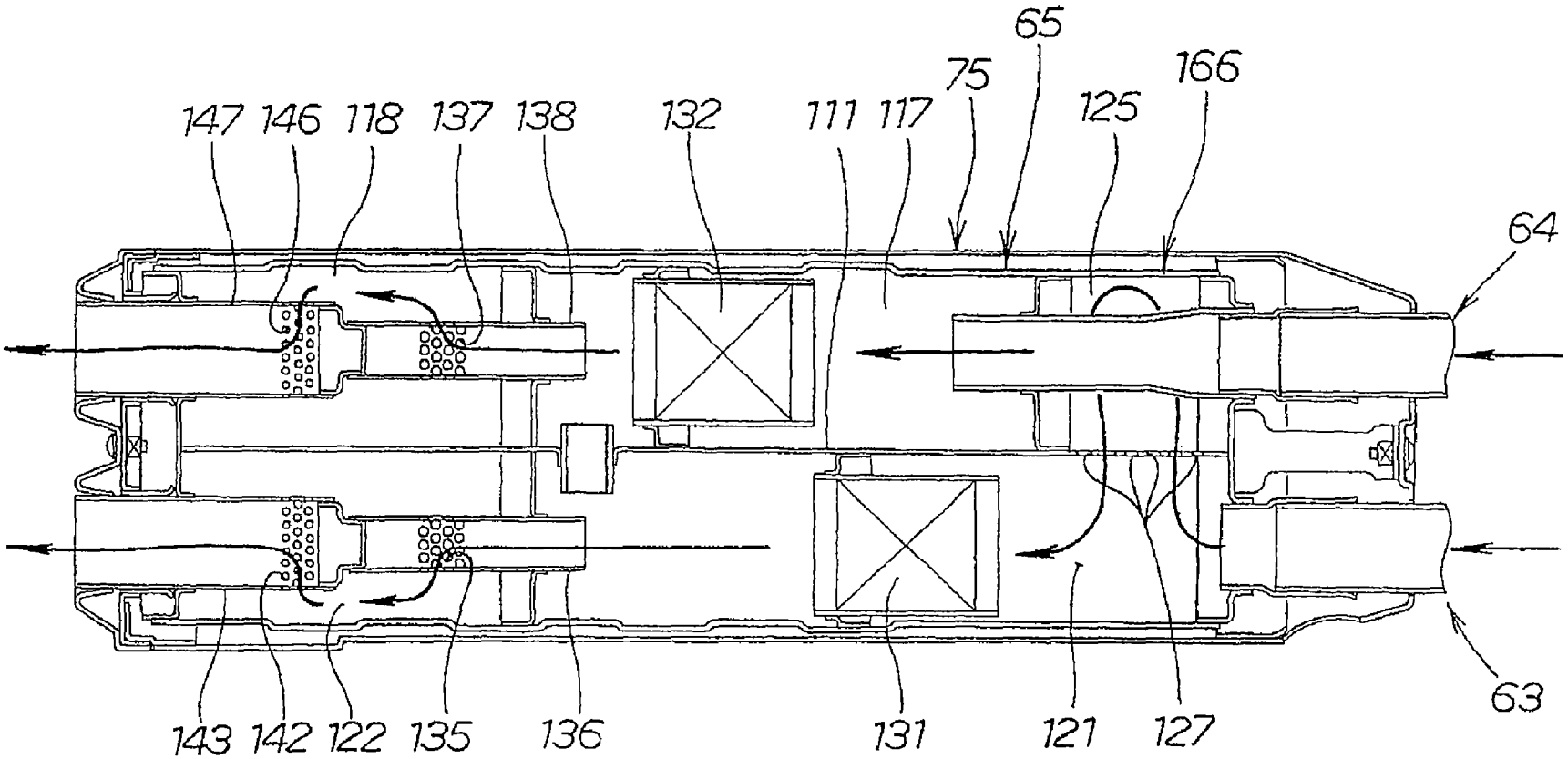
FIG. 3 is a view illustrating the operation of the saddle-ride type vehicle in FIG. 2.

In FIG. 3, an exhaust gas from the front exhaust pipe 63 flows to the lower first chamber 121 constituting the expansion chamber, and partially flows also to the protruding space 125 protruding to a side of the upper first chamber 117, through the through holes 127 opened in the first separator 111. The exhaust gas in the lower first chamber 121 and the exhaust gas returning from the upper first chamber 117 together pass through the first catalyst unit 131. Then, the exhaust gas reaches the lower second chamber 122 through the multiple holes 135 provided in the lower joining pipe 136, enters the lower tail pipe 143 through the rear multiple holes 142 provided in the lower tail pipe 143, and is then discharged to the outside from the rear end portion of the lower tail pipe 143.

Meanwhile, an exhaust gas from the rear exhaust pipe 64 flows to the upper first chamber 117 constituting the expansion chamber, and passes through the second catalyst unit 132. Then, the exhaust gas reaches the upper second chamber 118 through the multiple holes 137 provided in the upper joining pipe 138, enters the upper tail pipe 147 through the rear multiple holes 146 provided in the upper tail pipe 147, and is then discharged to the outside from the rear end portion of the upper tail pipe 147.

Since the protruding space 125 is formed protruding from the lower first chamber 121, which is the expansion path for one of the cylinders, to the side of the upper first chamber 117, which is the expansion path for a different one of the cylinders, the lower first chamber 121 provided in the expansion path for the one cylinder has a capacity different from that of the upper first chamber 117 provided in the expansion path for the different cylinder. In other words, the upper first chamber 117 has a smaller capacity than the lower first chamber 121. Thereby, the upper first chamber 117 and the lower first chamber 121 can have different capacities without changing the overall capacity of the silencer 65.

When the protruding space 125, which is a part protruding to the side of the expansion path for the different cylinder, is called an protruding portion 166 of the one cylinder, the protruding portion 166 is placed between the multicylinder engine (V-type engine 35 side) and the upper first chamber 117 provided in the expansion path for the different cylinder is. When the lower first chamber 121, which is the expansion path led from the one cylinder, is provided close to the V-type engine 35, a pressure of an exhaust gas (exhaust back pressure) can be effectively reduced.

Also referring to FIG. 1, in the V-type engine 35 in which the front cylinder 61 and the rear cylinder 62 have a narrow angle therebetween with the crankshaft 53 being the center, the front cylinder 61 has a better intake efficiency than the rear cylinder 62. Therefore, the front cylinder 61 often has a higher output than the rear cylinder 62. In such a case, according to the output difference between the front cylinder 61 and the rear cylinder 62, the capacity of the lower first chamber 121 of the expansion path led from the front cylinder 61 is made larger than the capacity of the upper first chamber 117 of the expansion path led from the rear cylinder 62, to thereby reduce the exhaust back pressure in the lower first chamber 121 being the expansion path. By reducing the exhaust back pressure, an output of the engine 35 can be improved. Further, an exhaust noise and output characteristics can be varied by increasing the output difference between the front and rear cylinders 61 and 62. Therefore, a further comfortable driving experience can be achieved.

In short, by adjusting the relative capacities of the individual chambers in the silencer 65, the capacity of the expansion path constituting the exhaust system of the multicylinder engine 35 can be changed for each cylinder. Accordingly, the performance of the engine 35 can be improved without increasing the size of the silencer 65.

A detailed description is given, using the next drawing, as to changing the capacity of each of the multiple expansion paths, for each cylinder.

Figure 4A:
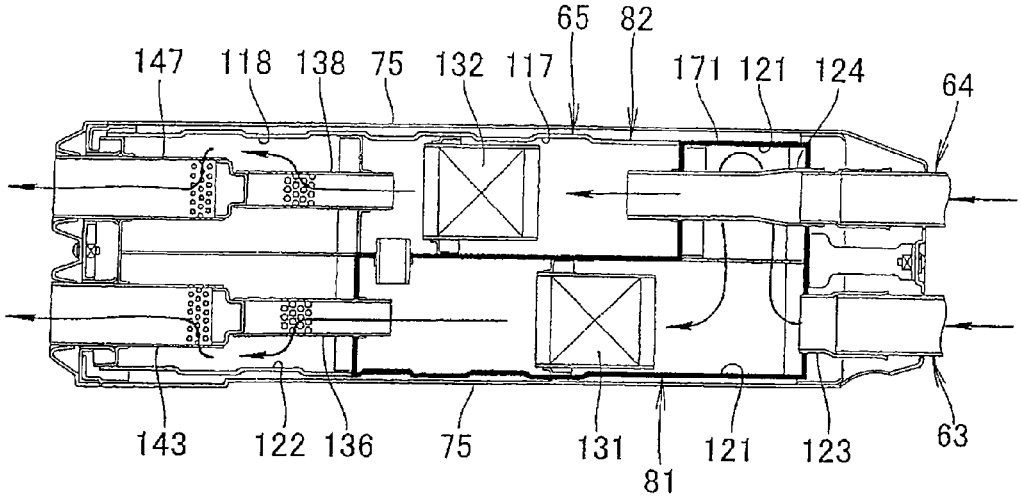
FIGS. 4(*a*) and 4(*b*) are views illustrating capacities of expansion paths provided in the silencer according to the present invention.
Figure 4B:
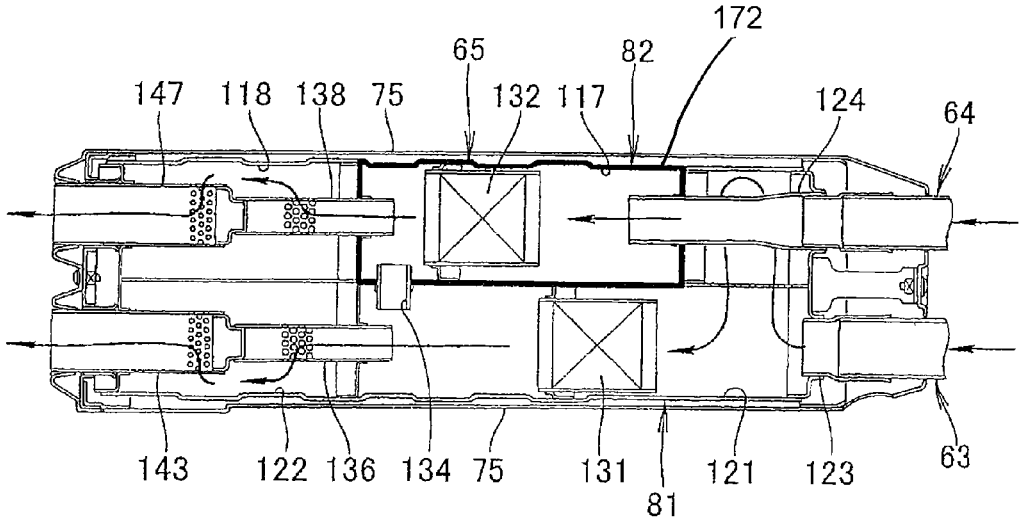

In FIG. 4(*a*), the region of the lower first chamber 121 is enclosed by a heavy line 171. In FIG. 4(*b*), the region of the upper first chamber 117 is enclosed by a heavy line 172.

As described, in the present invention, the expansion paths 81 and 82 which are led from the front and rear cylinders (denoted by reference numerals 61 and 62 in FIG. 1), respectively, and constitute the silencer 65 have different capacities from one another. For example, the lower first chamber 121 being the expansion path having a large capacity is connected to the front cylinder 61 having a large engine output, and the upper first chamber 117 being the expansion path having a small capacity is connected to the rear cylinder 62 having a smaller output than the front cylinder 61.

In other words, an expansion path having an appropriate capacity according to the output difference of the cylinders can be allocated to each cylinder. In this way, a pressure against the exhaust gas discharge (exhaust back pressure) can be reduced in the expansion paths of the cylinders. Reducing the exhaust back pressure allows improvement in the output of the engine 35.

Figure 5A:
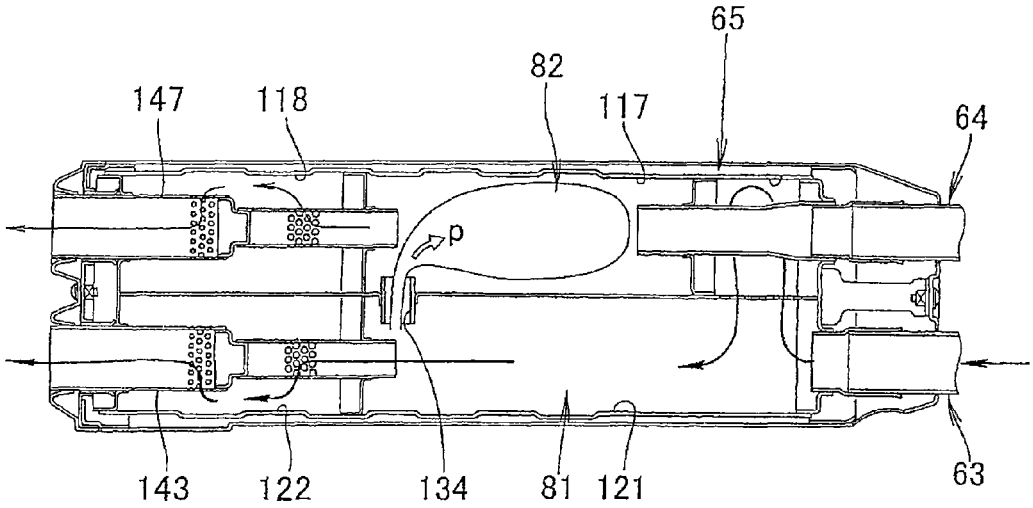
FIGS. 5(*a*) and 5(*b*) are views illustrating the operation of a communication hole provided in the silencer according to the present invention.
Figure 5B:
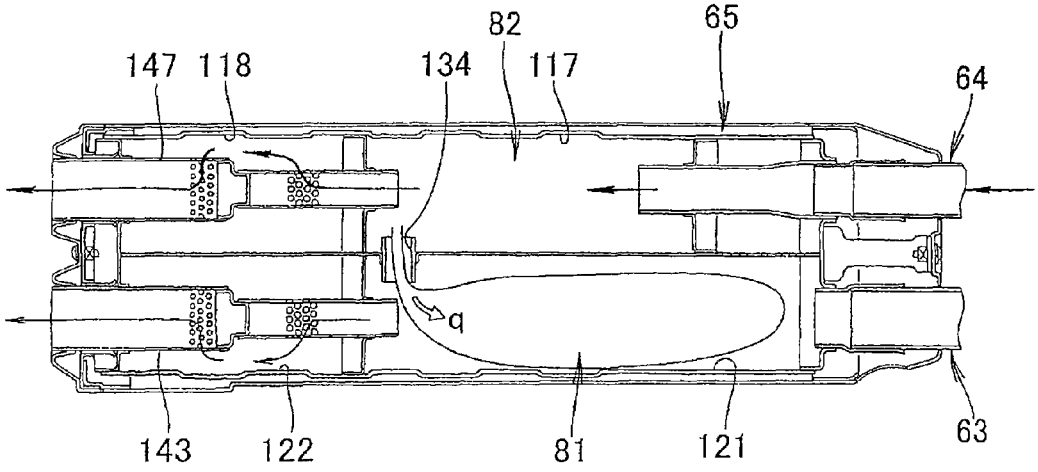
Figure 6A:
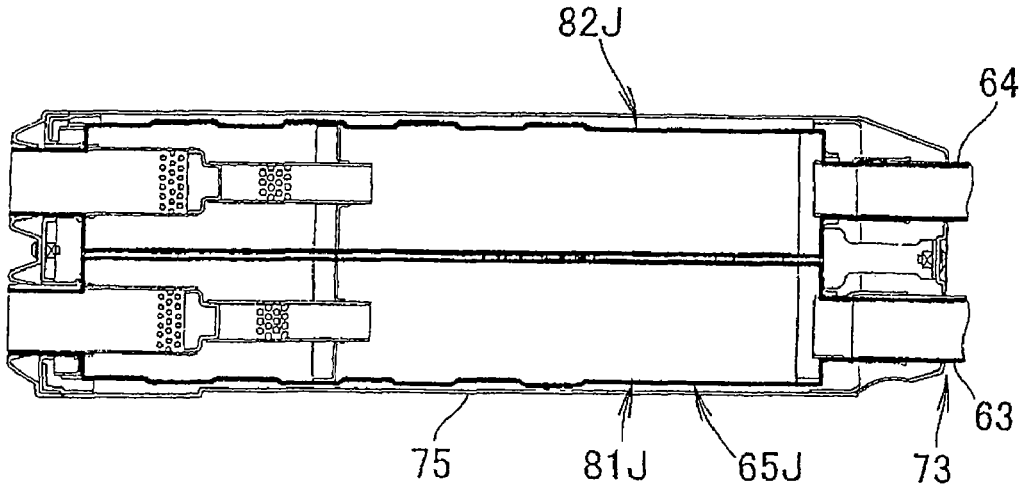
FIGS. 6(*a*) and 6(*d*) are views illustrating a modification of the saddle-ride type vehicle in FIG. 2.
Figure 6B:
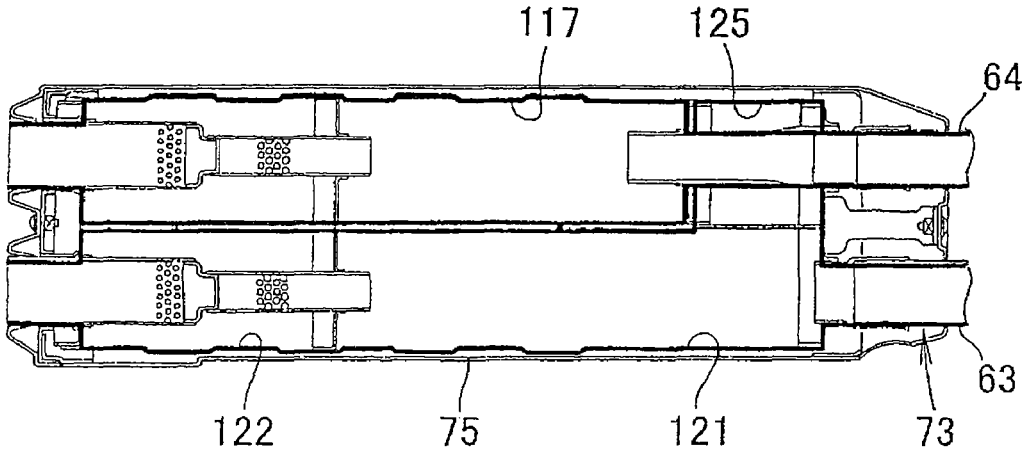
Figure 6C:
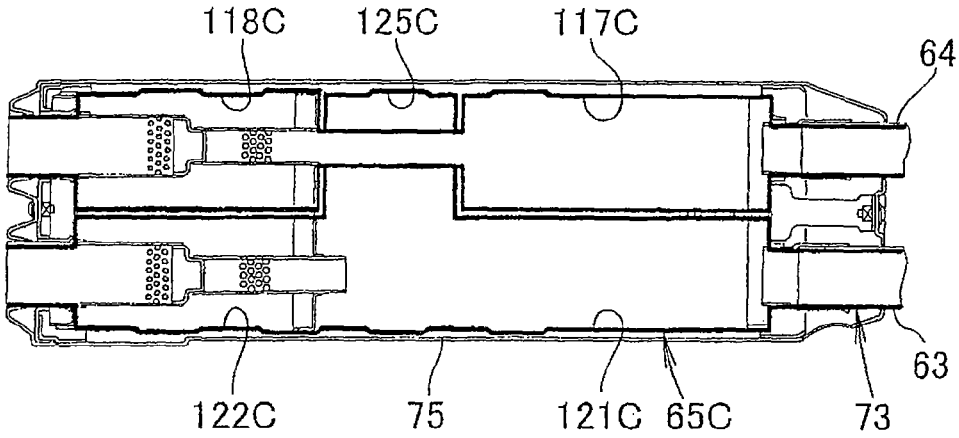
Figure 6D:
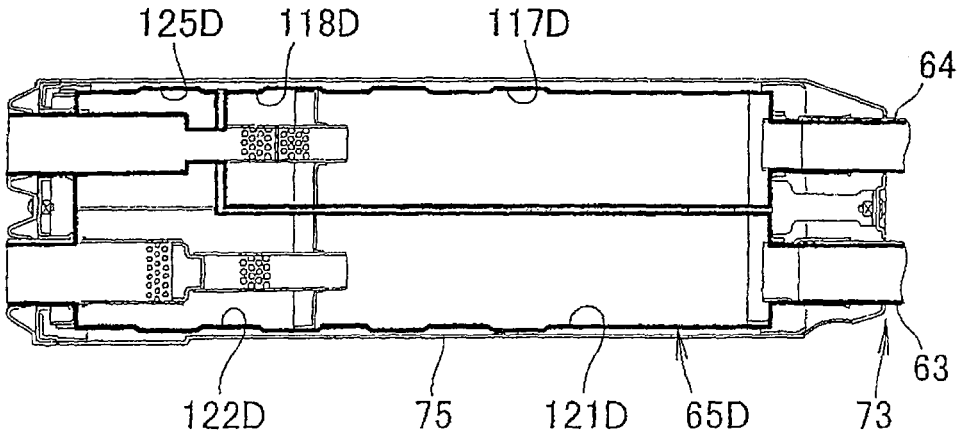

In FIG. 5, the lower first chamber 121, which is the expansion path for one of the cylinders communicates with the upper first chamber 117, which is the expansion path for at least one different cylinder of the cylinders, through the communication hole 134 through which the exhaust gas passes. In the multicylinder engine 35, the cylinders usually have different combustion timings.

In FIG. 5(*a*), when combustion occurs in the front cylinder (denoted by reference numeral 61 in FIG. 1), an exhaust gas flows from the lower first chamber 121 to the lower second chamber 122, and is then discharged from the rear end portion of the lower tail pipe 143. At this time, the exhaust gas in the lower first chamber 121 partially flows in a direction denoted by an arrow p through the communication hole 134, and moves to the upper first chamber 117. Then, the exhaust gas enters the upper second chamber 118, moves to the upper tail pipe 147 from the upper second chamber 118, and is then discharged to the outside from the rear end portion of the upper tail pipe 147.

In FIG. 5(*b*), when combustion occurs in the rear cylinder (denoted by reference numeral 62 in FIG. 1), an exhaust gas flows from the upper first chamber 117 to the upper second chamber 118, and is then discharged from the rear end portion of the upper tail pipe 147. At this time, the exhaust gas in the upper first chamber 117 partially flows in a direction denoted by an arrow q through the communication hole 134, and moves to the lower first chamber 121. Then, the exhaust gas enters the lower second chamber 122, moves to the lower tail pipe 143 from the lower second chamber 122, and is then discharged to the outside from the rear end portion of the lower tail pipe 143.

If the multiple cylinders are ignited at different timings, the expansion paths 81 and 82 have different peaks of the exhaust back pressure. By making the expansion paths 81 and 82 communicate with each other through the communication hole 134, an exhaust back pressure on the high pressure side can escape to the low pressure side, and thereby the exhaust back pressure can be reduced. Accordingly, the performance of the engine (denoted by reference numeral 35 in FIG. 1) can be efficiently improved while maintaining the rigidity of the silencer 65 without increasing the number of components.

Referring to FIGS. 6(*a*) to 6(*d*), descriptions are given below of a comparative example, an example embodiment, and modifications. In these drawings, the catalyst units are not shown.

FIG. 6(*a*) shows a comparative example in which the two front and rear exhaust pipes 63 and 64 extending from the narrow-angle V-type engine are led to a silencer 65J having independent expansion paths 81J and 82J formed in a single cylindrical member.

Cylinders forming a multicylinder engine are different from each other in their positions and orientations, and consequently, in their intake efficiencies and the like. Difference in the intake efficiencies causes an output difference among the cylinders.

Even in the case where there is an output difference among the cylinders, the expansion paths led from the respective cylinders have the same capacity in some cases, as shown in FIG. 6(*a*). In such a case, the expansion path led from a cylinder having a large output has a larger exhaust back pressure than the expansion path led from a cylinder having a small output, possibly not allowing the cylinders to fully exert their capabilities.

FIG. 6(*b*) shows an example embodiment in which the protruding space 125 protruding upward from a part of the lower first chamber 121 is provided close to the engine (denoted by reference numeral 35 in FIG. 1) in a front-rear direction of the vehicle. In other words, the protruding space 125 is placed at the front end portion of the silencer 65.

FIG. 6(*c*) shows a modification in which a protruding space 125C is placed at a middle portion of an upper first chamber 117C.

FIG. 6(*d*) shows another modification in which a protruding space 125D is placed close to the tail pipe of an upper first chamber 117D. In other words, the protruding space 125D is placed at the rear end portion of the silencer 65.

In FIGS. 6(*a*) to 6(*d*), the motorcycle (reference numeral 10 in FIG. 1) being a saddle-ride type vehicle employs the following exhaust-pipe structure. The exhaust pipes 73 are led from the respective cylinders of the multicylinder engine 35, and the single silencer 65 is connected to the downstream ends of these exhaust pipes. In the silencer 65, independent expansion paths that are equal in number to the number of the cylinders of the multicylinder engine 35 are formed. In FIGS. 6(*b*) to (*d*) among these drawings, the expansion paths led from the respective cylinders have different capacities from one another.

Next, a description is given of the silencer 65 constituting the exhaust-pipe structure described above. Referring back to FIG. 2, the lower first chamber 121 provided in the expansion path for one of the cylinders and the upper first chamber 117 provided in the expansion path for a different one of the cylinders have different capacities by forming the lower first chamber 121, which is the expansion path for the one cylinder, in such a manner as to protrude to the side of the upper first chamber 117, which is the expansion path for the different cylinder. Thereby, the upper first chamber 117 and the lower first chamber 121 can have different capacities without changing the overall capacity of the silencer 65. Accordingly, the performance of the engine 35 can be improved efficiently without increasing the size of the silencer 65. Moreover, the exhaust sound can be improved.

Figure 7:
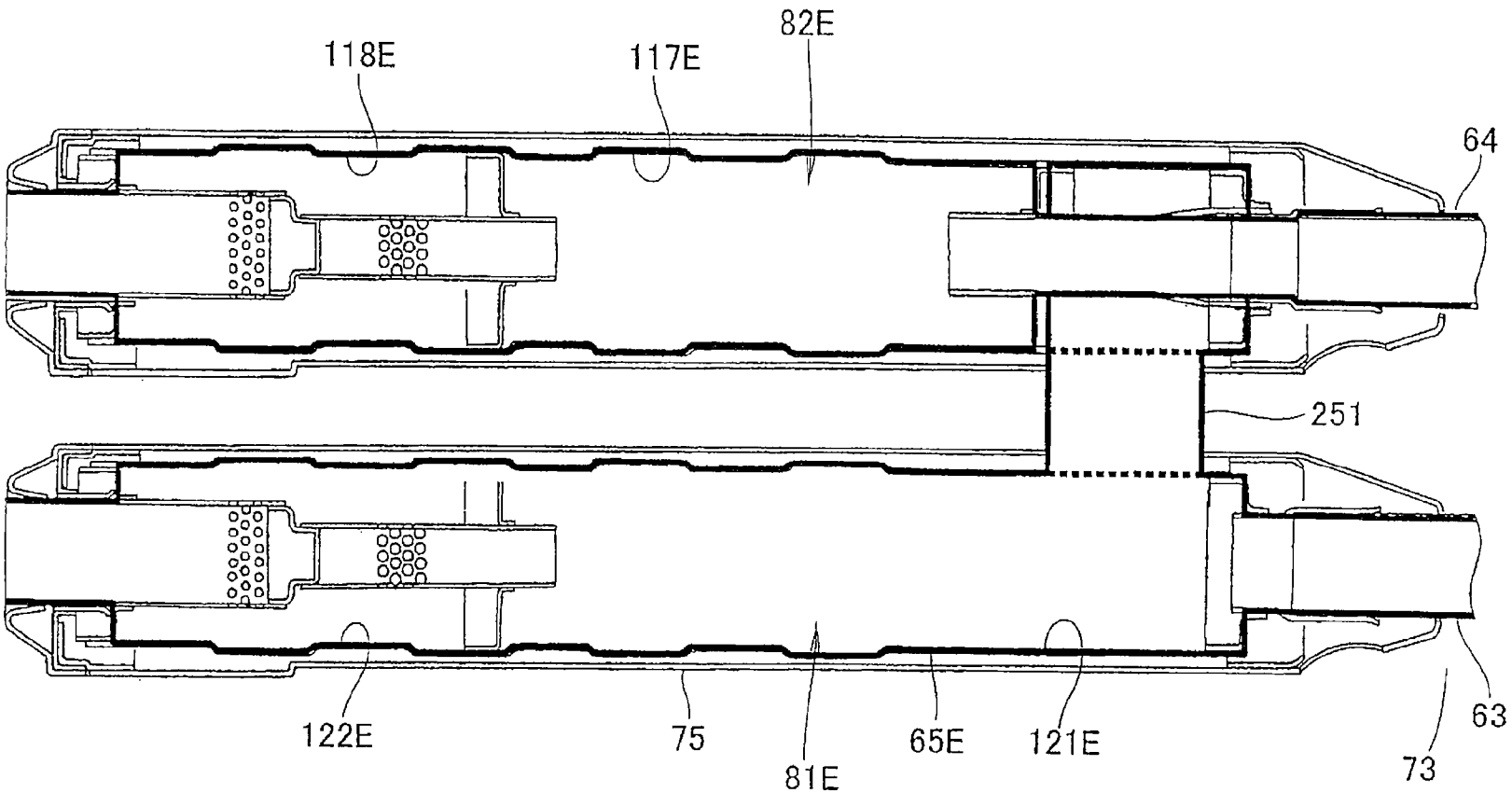
FIG. 7 is a view illustrating another modification of the saddle-ride type vehicle in FIG. 2.

FIG. 7 shows another example embodiment. In this example, a lower expansion path 81E, which is the expansion path for one of the cylinders, is formed protruding to a side of an upper extension path 82E, which is the expansion path for a different one of the cylinders. Thereby, a lower first chamber 121E, which is the first chamber provided in the lower expansion path 81E, has a different capacity from an upper first chamber 117E, which is the first chamber provided in the expansion path for the different cylinder.

Compared to the example embodiment described earlier, a difference is that a silencer 65E is formed of independent upper and lower silencers, and consequently, the expansion paths 81E and 82E are independently placed in the respective multiple silencers, and that a bridge pipe 251 is provided between the expansion paths 81E and 82E. There is no other functional difference.

Since the lower first chamber 121E and the upper first chamber 117E have different capacities, an appropriate capacity for its expansion path can be allocated to each of the cylinders by efficiently using the overall capacity of the silencer 65E. Accordingly, even in a case of using a silencer having independent parts for the respective cylinders, the performance of the engine (denoted by reference numeral 35 in FIG. 1) can be efficiently improved without increasing the size of the silencer 65E.

In the embodiment, the present invention is applied to a motorcycle. It should be noted, however, that the present invention can be applied to a three-wheeler and a four-wheeler, and may also be applied to a general vehicle.

The exhaust-pipe structure of the present invention is preferably used for the exhaust-pipe structure of a motorcycle.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. An exhaust-pipe structure for saddle-ride type vehicle, comprising:

a single silencer connected to downstream ends of a plurality of exhaust pipes led from respective cylinders of a multicylinder engine, the single silencer having a plurality of chambers that are equal in number to the respective cylinders of the multicylinder engine, said plurality of exhaust pipes opening into said plurality of chambers, a separator which divides said single silencer into said plurality of chambers, catalyst units provided in each of said plurality of chambers, and a communication hole opened at a position rearward of the catalyst units to allow communication of an exhaust gas between said plurality of chambers, wherein the plurality of chambers have different capacities from each other, wherein the multicylinder engine is a V-type engine having a crankshaft extending in a vehicle-width direction and having a front cylinder and a rear cylinder, wherein a capacity of a chamber corresponding to the front cylinder is larger than a capacity of a chamber corresponding to the rear cylinder, wherein said chamber corresponding to the front cylinder of the multicylinder engine includes a protruding portion which protrudes towards said chamber corresponding to the rear cylinder of the multicylinder engine, such that a capacity of said chamber corresponding to the front cylinder is different from a capacity of said chamber corresponding to the rear cylinder, and wherein said separator includes through holes which allow communication between (i) said protruding portion which protrudes towards said chamber corresponding to the rear cylinder of the multicylinder engine and (ii) a non-protruding portion of said chamber corresponding to said front cylinder of the multicylinder engine.

2. The exhaust-pipe structure for saddle-ride type vehicle according to claim 1, wherein said chamber corresponding to the front cylinder and said chamber corresponding to the rear cylinder communicate with each other via said communication hole.

3. The exhaust-pipe structure for saddle-ride type vehicle according to claim 1, wherein said protruding portion is disposed between the multicylinder engine and said chamber corresponding to the rear cylinder of the multicylinder engine.

4. The exhaust-pipe structure for saddle-ride type vehicle according to claim 2, wherein said protruding portion is disposed between the multicylinder engine and said chamber corresponding to the rear cylinder of the multicylinder engine.

5. An exhaust-pipe structure for saddle-ride type vehicle, comprising:

a plurality of silencers, each connected to a downstream end of a plurality of exhaust pipes led from respective cylinders of a multicylinder engine, the plurality of silencers cumulatively having formed therein a plurality of chambers that are equal in number to the respective cylinders of the multicylinder engine, said plurality of exhaust pipes opening into said plurality of chambers, and a bridge pipe connecting said plurality of silencers such that said plurality of silencers communicate with each other, wherein a chamber corresponding to a first cylinder of the multicylinder engine protrudes from the silencer of the chamber corresponding to the first cylinder to a side of a chamber corresponding to a second cylinder of the multicylinder engine, such that a capacity of said chamber corresponding to the first cylinder is different from a capacity of said chamber corresponding to the second cylinder, wherein said chamber corresponding to the first cylinder of the multicylinder engine is formed in a first silencer of said plurality of silencers, said bridge pipe, and a first portion of a second silencer of said plurality of silencers, wherein said chamber corresponding to the second cylinder of the multicylinder engine is formed in a second portion of said second silencer of said plurality of silencers, and wherein said first portion of said second silencer is disposed between the multicylinder engine and said chamber corresponding to the second cylinder of the multicylinder engine.

6. The exhaust-pipe structure for saddle-ride type vehicle according to claim 5, wherein the multicylinder engine is a V-type engine having a crankshaft extending in a vehicle-width direction and being formed of a front cylinder and a rear cylinder, wherein the first cylinder is the front cylinder of the V-type engine, and wherein the second cylinder is the rear cylinder of the V-type engine.

* * * * *